United States Patent [19]

Antosiak

[11] 3,991,681

[45] Nov. 16, 1976

[54] DISC TYPE PRESS WITH HYDROSTATIC BEARINGS

[75] Inventor: Jerzy Antosiak, Warsaw, Poland

[73] Assignee: Osrodek Badawczo-Rozwojovy Obrobky Plastycznej Metali "Plasomet", Warsaw Ul. Cracklego, Poland

[22] Filed: May 8, 1975

[21] Appl. No.: 575,962

[30] Foreign Application Priority Data

May 22, 1974 Poland ..... 171314

[52] U.S. Cl. ..... 100/257; 72/452; 74/55; 74/571 R; 83/628; 100/266; 100/292

[51] Int. Cl.[2] ..... B30B 1/26

[58] Field of Search ..... 72/452; 83/602, 628; 74/571 R, 55, 600; 100/292, 257, 266

[56] References Cited

UNITED STATES PATENTS

| | | | |
|---|---|---|---|
| 2,172,701 | 9/1939 | Eustege | 100/292 |
| 2,592,237 | 4/1952 | Bradley | 74/571 R |
| 3,421,397 | 1/1969 | Clark | 100/292 X |
| 3,662,640 | 5/1972 | Wrona | 100/292 X |

FOREIGN PATENTS OR APPLICATIONS

| | | | |
|---|---|---|---|
| 2,111,988 | 11/1971 | Germany | 72/452 |

*Primary Examiner*—Billy J. Wilhite
*Attorney, Agent, or Firm*—Haseltine, Lake & Waters

[57] ABSTRACT

A disc type press having hydrostatic bearings in the ram driving mechanism and a device for varying the distance between the ram and table. This device is located in the press head and is provided with a separate drive. Upper slipper pads are mounted on the ends of screws screwed into the press head. The screws are coupled with each other by a driving mechanism with adjustable speed and torque. The driving discs are provided with transverse, hydrostatic or roller bearings.

6 Claims, 6 Drawing Figures

A-A

DISC TYPE PRESS WITH HYDROSTATIC BEARINGS

Figure 1:
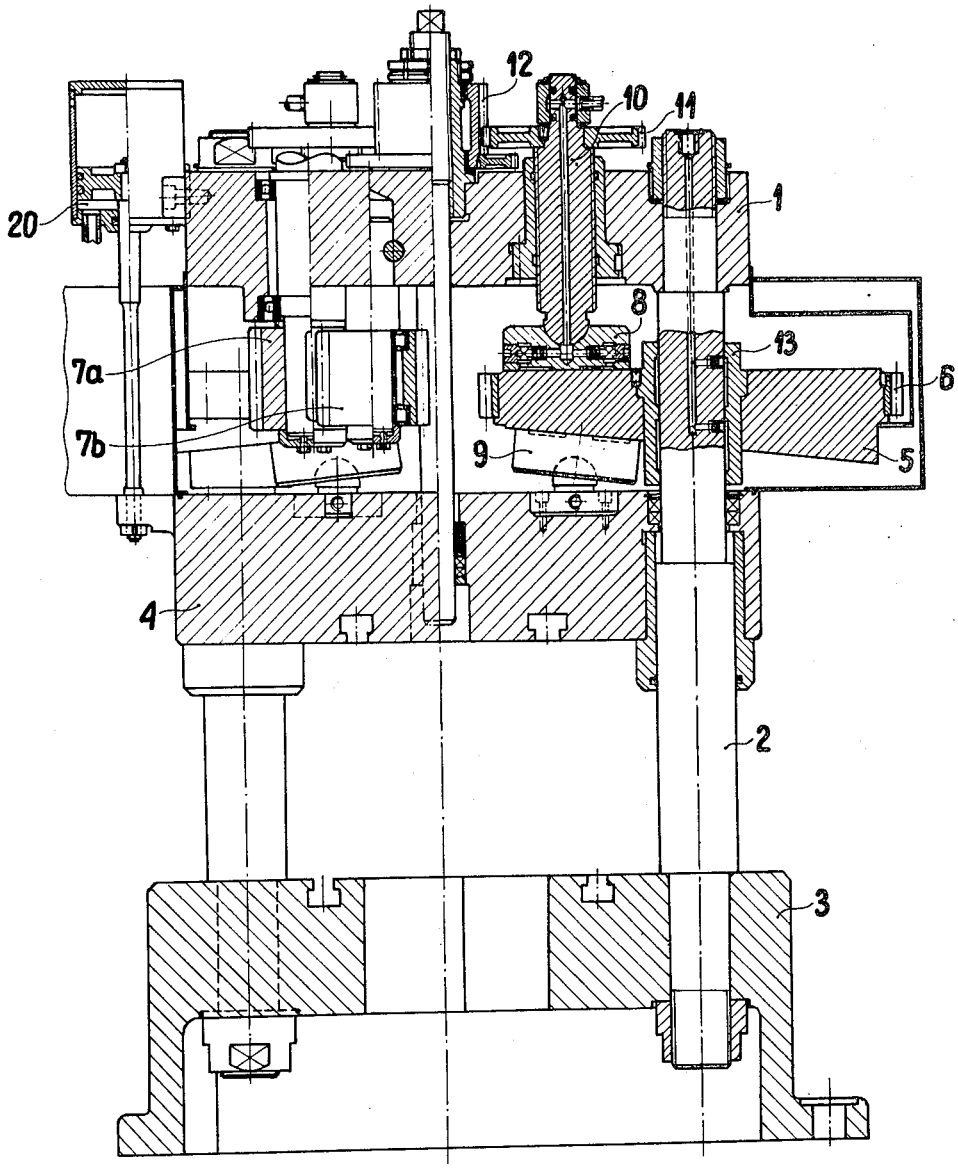

An object of this invention is to provide an improved disc type power press with hydrostatic bearings in a ram driving mechanism.

The power press disclosed in Polish Pat. No. 68,425 is provided with one or more driving discs with wedge inclined surfaces in the ram driving system. These discs are located between the press head and ram. The press is provided further with sliding elements mounted in a self-aligning manner in the press body and ram, located on both sides of the driving discs and remaining in permanent contact with the non-parallel sliding surfaces of these discs. The press is provided with a device causing the return motion of the ram. This press is also provided with a device for adjusting the initial distance between the ram and press table. This device is equipped with movable wedges mounted in the ram and moving under the housing in which, in turn, are mounted the above mentioned sliding elements.

In the existing version of the press, the device for adjusting the distance, has nuts mounted on the table which are able to move up and down on threaded portions of the columns.

This press has some disadvantages. It is characterized by a rather small stroke of the ram caused by a limited inclination of the driving disc surfaces. As a result, it may be successfully employed for punching, coining and shallow pressing only. The devices for adjustment of the ram to table distance either built into the table or ram are subjected to vibrations transferred directly from the die. In addition, the wedge mechanism built into the ram increases the mass of elements taking part in the reciprocating movement and the device with nuts built into the table cuts down the freedom of adapting the table design to the technological requirements.

Additionally, there is the power press presented in the description of a patent of addition to the Polish Pat. No. 68,425. This press is provided with a device for driving the nuts which move the table in a vertical direction. The upward movement of the table starts at the moment when the ram together with the tool begins its return stroke. As a result, the ram in the next working stroke can penetrate deeper into the material. The sum of these two movements gives deep pulsatory pressing with separation of the stamp from the material.

The design described represents an essential improvement of the disc type power press. However, the devices for moving the table are complicated to some degree. Also the technological requirements within the press table space are not completely fulfilled.

The essence of this invention consists of mounting the hydrostatically counter balanced slipper pads, which are in contact with the upper surfaces of the driving discs, on screws attached to the press head. These driving discs are mounted on columns so that they can rotate and move vertically on the columns. For this reason, the driving discs are provided with transverse, hydrostatic or roller bearings, mounted on sleeves to allow for vertical movement.

The press, according to this invention is further provided with a device for simultaneously driving the screws, on which the hydrostatically counter balanced slipper pads are mounted. In addition, the press is provided with a spring operated mechanism for driving the ram return stroke, coupled with a device for altering the distance between the ram and table. For this purpose, pneumatically or hydraulically actuated return devices can also be used. The screws, on which the upper slipper pads are mounted, are driven by an electric motor cooperating with the variable-speed transmission and clutch. The most convenient clutch is of twist-spring, slip or hydro-kinetic type. In place of a conventional motor and variable-speed transmission, a motor with adjustable speed or step type can be used connected directly with the device coupling the screws. Any other motor with similar action can be used as well.

The press according to invention offers the following advantages: (1) All the mechanisms are located in its head. (2) The table surface can be used as a whole for technological requirements. (3) The mechanisms for altering the distance of ram to table can be used either during press standstill for initial adjusting of the distance of ram to table or during press operation. In this case, the invention renders the possibility to use the press for deep, pulsatory pressing with separation of the stamp from material. This mechanism is simplified and its range of adjustment is larger than in the case of a mechanism built into the press ram.

Figure 2:
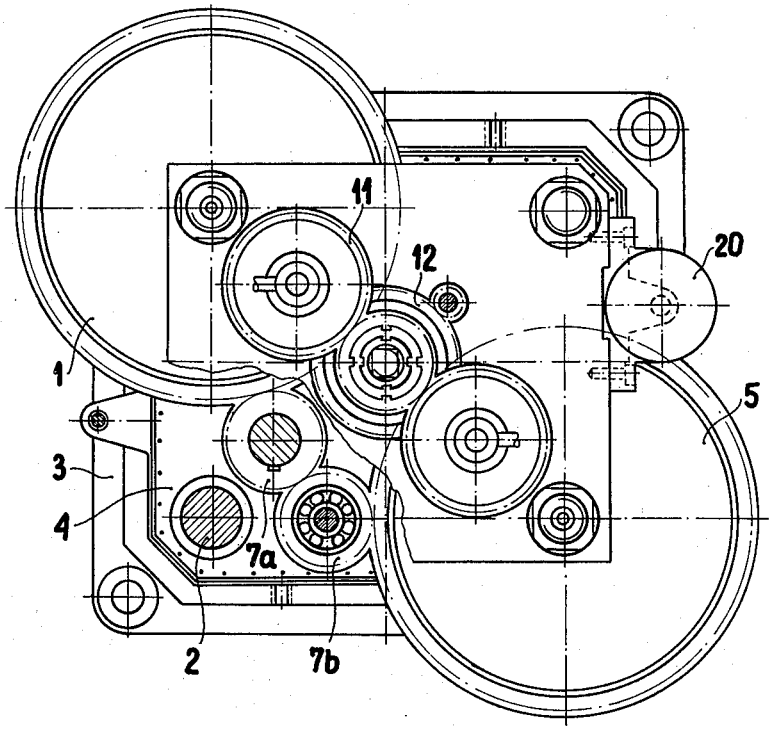
Figure 3:
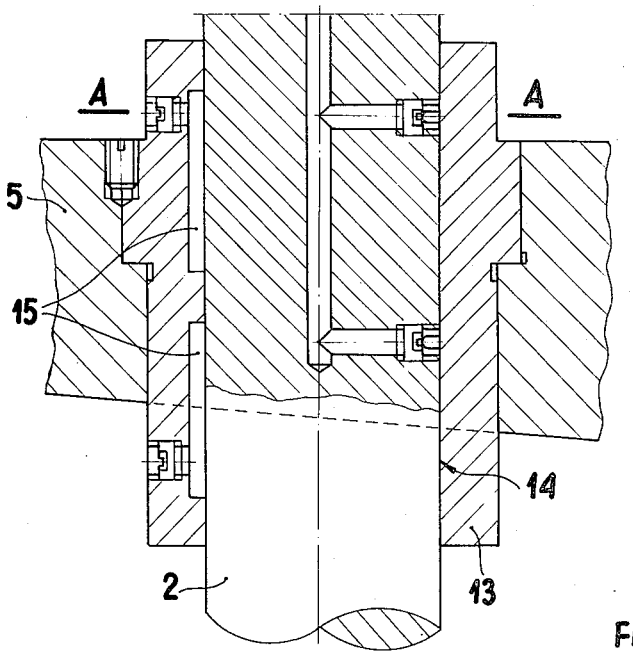
Figure 4:
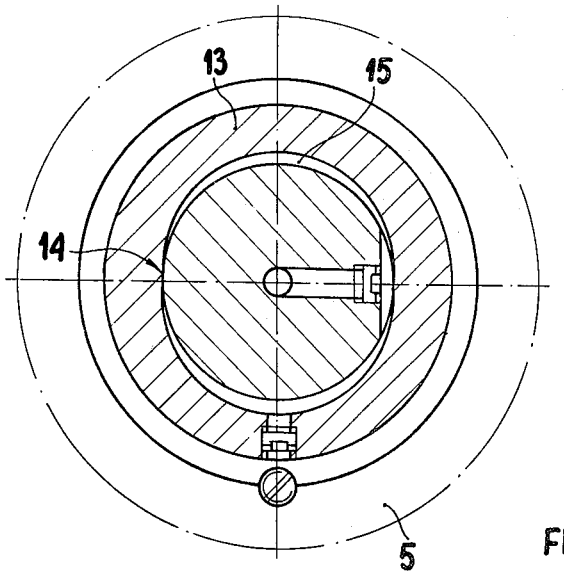
Figure 5:
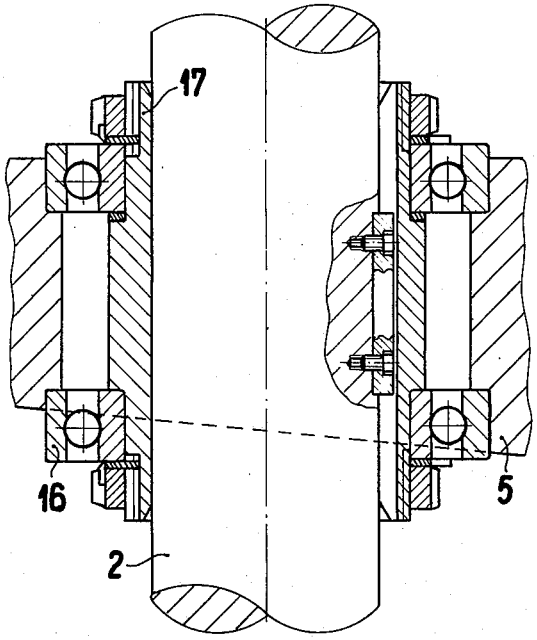
Figure 6:
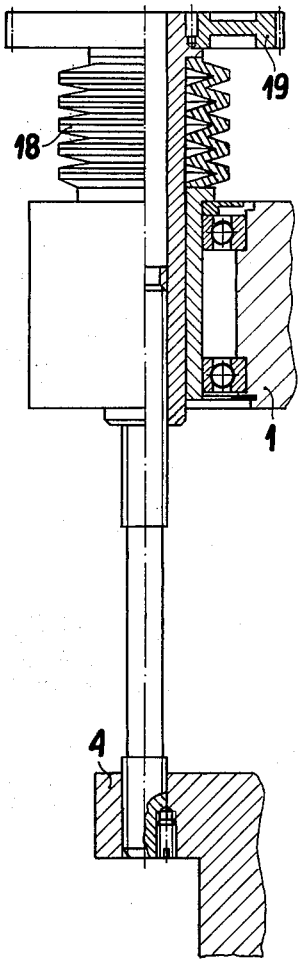

The subject of invention is more precisely described by the embodiment shown in the enclosed drawings in which; FIG. 1 shows the press in vertical cross-section; FIG. 2 is a top plan view of the press after removal of guards; FIG. 3 shows a detail of the driving disc plain bearing in vertical cross-section; FIG. 4 is a horizontal cross-section taken along line A—A in FIG. 3; FIG. 5 shows a detail of the roller bearing of the driving disc in vertical cross-section; and FIG. 6 is a side view of a detail of the press with spring counter balancer.

As it can be seen in the drawing, the press body is composed of head 1 connected by means of columns 2 with table 3 which forms the press base. A ram 4 located movably on columns 2 is located under the press head. Driving discs 5 having teeth 6 machined on their periphery are located between the ram and the press head. The disc teeth are in mesh with intermediate gears 7*a* and 7*b*. Hydraulically counter-balanced slipper pads 8 are in contact with the upper surfaces of the discs 5 and similar pads 9 mounted in self-aligning manner in the ram 4, are in contact with the lower surfaces of these discs.

The slipper pads 8, are mounted in self-aligning manner at the ends of screws 10, screwed into the head 1. Gears 11 mounted on the upper ends of screws 10, are in mesh with intermediate gear 12 driven by a transmission (not shown) connected with an electric motor.

The discs 5 are mounted on the columns 2 so that they can rotate and move up and down. These discs are mounted on long sleeves 13 provided with sliding surfaces 14 and recesses 15 which are fed with oil under pressure and ensure the hydrostatic counter balance of bearings.

In a favorable modification of the press, the discs 5 are mounted on roller bearings 16 which in turn, are located on sleeve 17 which can move up and down on column 2.

A spring counter balancer (shown in FIG. 6) serves for driving the return motion of the ram 4 and is provided with a set of springs 18. The balancer is coupled with the mechanism for altering the distance of the ram to the table, by means of the gear 19.

The ram 4 return move can be driven by a recoil mechanism 20 which can be of pneumatic or hydraulic type.

The press according to invention, operates in the following manner:

When the ram 4 is at its upper dead point the discs 5 are between the sliding elements 8 and 9 with their smallest thickness. When the discs 5 start to rotate, their thickness between the slipper pads 8 and 9 increases and overcomes the resistance of the balancing and return mechanisms and exerts a pressure to move the ram downwards. When the discs 5 are turned by more than 180°, their thickness between the pads 8 and 9 decreasing, and the ram 4, under the action of the counter balancing and return mechanisms, is moved upwards up to its upper dead point.

The action of the mechanisms for altering the distance of the ram to the table is clear enough when used during standstill of the ram and does not require explanation. The same mechanisms, however, can be used during movement of the ram and then they alter the character of the press operation. By engaging the drive of screws 10 when the ram is moving upwards and the tool is separated from the material, the screws 10 being free of load, are screwed into the press head 1. As a result, the discs 5 are moved downwards by some amount. When the ram in turn performs its next working stroke, the tool enters more deeply into the material than previously. In this way, deep, pulsatory pressing of material takes place, with separation of the stamp from the material at every stroke of the ram. This is particularly favorable with regard to cooling and lubricating the tool.

The intermediate gears 7*a* and 7*b* for driving the discs 5 as well as the gear 12 for driving the screws 10 have teeth of great length, to ensure their mesh with gears 6 and 11 over the whole length of travel of the screws 10. The described transverse bearings of discs 5 in the sliding as well as in the roller versions, ensure an easy vertical displacement of the discs during pulsatory pressing, and setting of the initial distance of ram 4 to table 3.

What I claim is:

1. A disc type power press comprising a table, columns on said table, a head on said columns, a ram displaceably mounted on said columns, at least one rotatable driving disc of wedge shape, bearing means supporting said disc on a respective column for rotation and axial displacement, upper and lower opposed slipper pads, a threaded member screwed into said head and having a lower end carrying said upper slipper pad, said lower slipper pad being mounted on said ram with the wedge shape driving disc interposed therebetween in contact with the slipper pads, and a drive means for said threaded member to advance or retract the same in said head thereby to displace the upper slipper pad correspondingly.

2. A power press as claimed in claim 1 wherein a plurality of said driving discs are mounted on respective columns, each disc being associated with a respective threaded member and a pair of upper and lower slipper pads, said drive means being common to the threaded members associated with said driving discs.

3. A power press as claimed in claim 2 wherein said driving means comprises a drive gear on each threaded member and a common intermediate gear in mesh with the drive gears for driving the latter.

4. A power press as claimed in claim 1 wherein said bearing means comprises a sleeve supporting said disc and slidable on said respective column, said sleeve having sliding surfaces in contact with said column and recesses fed with pressure fluid to ensure hydrostatic counter balance of said bearing means.

5. A power press as claimed in claim 1 wherein said bearing means comprises a sleeve slidable on said respective column, and roller bearings mounting said disc on said sleeve.

6. A power press as claimed in claim 1 comprising adjuster means coupled to said ram and supported by said head for adjusting the distance between the ram and said table, and spring counter balancers coupled to said adjuster means for driving the ram in return motion.

* * * * *